United States Patent [19]

Wetzer

[11] 4,081,212

[45] Mar. 28, 1978

[54] SYSTEM FOR ELECTROSTATICALLY TRANSFERRING POWDER IMAGES

[75] Inventor: Antonius F. A. M. Wetzer, Eindhoven, Netherlands

[73] Assignee: Oce-van der Griten, N.V., Venlo, Netherlands

[21] Appl. No.: 631,240

[22] Filed: Nov. 12, 1975

[30] Foreign Application Priority Data

Nov. 18, 1974 Netherlands ..... 7414975

[51] Int. Cl.[2] ..... G03G 15/00

[52] U.S. Cl. ..... 355/3 TR; 96/1.4; 355/15; 427/24

[58] Field of Search ..... 355/3 R, 3 TR, 14, 15; 317/262 A; 427/19, 25, 146, 24; 96/1.4; 361/235

[56] References Cited

U.S. PATENT DOCUMENTS

| | | | |
|---|---|---|---|
| 3,464,818 | 9/1969 | Waly | 355/3 R X |
| 3,781,105 | 12/1973 | Meagher | 355/3 R |
| 3,795,025 | 3/1974 | Sadamitsu | 355/15 X |
| 3,819,263 | 6/1974 | Draugelis et al. | 355/3 R X |
| 3,860,857 | 1/1975 | Namiki et al. | 355/3 R X |
| 3,877,416 | 4/1975 | Donohue et al. | 355/3 R X |
| 3,907,421 | 9/1975 | Jordan et al. | 355/3 R |
| 3,918,966 | 11/1975 | Metcalfe et al. | 96/1.4 X |

*Primary Examiner*—Fred L. Braun
*Attorney, Agent, or Firm*—Albert C. Johnston

[57] ABSTRACT

In transferring powder images from a moving photoconductive support to a receiving material such as copy paper passing in contact with the support over a transfer roller, while both applying a direct current potential to effect image transfer and brushing the surface of the transfer roller to remove powder particles attracted to it from parts of the support. A potential effective for transferring the image is applied without hampering the cleaning action of the brush or brushes by maintaining between the support and the transfer roller a pulsating direct current which, for instance, has a frequency of 60 Herz or 50 Herz and preferably is generated by single phase rectification of a current formed by superimposing a sinusoidal alternating current and a direct current. The time interval between interruptions of the direct current potential is in any case kept less than both the contact time between the receiving material and the transfer roller and the contact time between the brush and the transfer roller, and the former contact time is preferably kept considerably longer than the latter.

11 Claims, 4 Drawing Figures

SYSTEM FOR ELECTROSTATICALLY TRANSFERRING POWDER IMAGES

This invention relates to an apparatus and process for electrostatically transferring powder images from a photoconductive support onto receiving material. The invention improves operations at the image transfer station of electrophotographic copying apparatus of a known type which comprises a rotatable transfer roller, means for transporting the image carrying support over the transfer roller with the image side of the support in face to face contact with a part of the circumference of the transfer roller, means for transporting receiving material between the support and the transfer roller, means for generating an electrical field between the support and the receiving material, and a cleaning device which includes a rotatable cylindrical brush for removing powder particles from the surface of the transfer roller.

An apparatus of that type is described, for instance, in U.S. Pat. No. 3,926,625. The known apparatus, however, has a disadvantage in that the cleaning action of the brush is adversely influenced by the electrical field which exists between the transfer roller and the brush, as a result of which powder particles are attracted to the transfer roller. This attraction can be explained as occurring because the image carrying support usually is electrically grounded, this being the case because, otherwise, difficulties may arise in the formation of images on the support. While the attraction to the transfer roller might be avoided by applying the same potential to the brush as to the transfer roller, this would only transpose the problem by causing powder to cling to the brush.

The object of the present invention is to overcome the above mentioned disadvantage by eliminating as far as practicable the influence, upon the cleaning of the transfer roller, of the roller potential that attracts the powder particles.

According to the present invention, it has been found that the object can be achieved by causing the electrical field between the support and the receiving material to be generated by means of a pulsating direct current. In this way the potential becomes temporarily zero at regular intervals, during which times the cleaning action of the brush is not hampered at all by the electrical field of the transfer roller; so the cleaning operation is greatly improved.

It is advantageous to select the frequency of the applied pulsating direct current so that the period time of the potential, i.e., the interval between successive interruptions of the current, is shorter that both the time of contact of any area of the photoconductive support with the receiving material and the time of contact of the cleaning brush with any area of the transfer roller. This assures that the current will be interrupted at least once during even the shortest contact time.

Other objects, features and advantages of the invention will be evident from the following description and the accompanying drawings of an illustrative embodiment of the invention. In the drawings.

Figure 1:
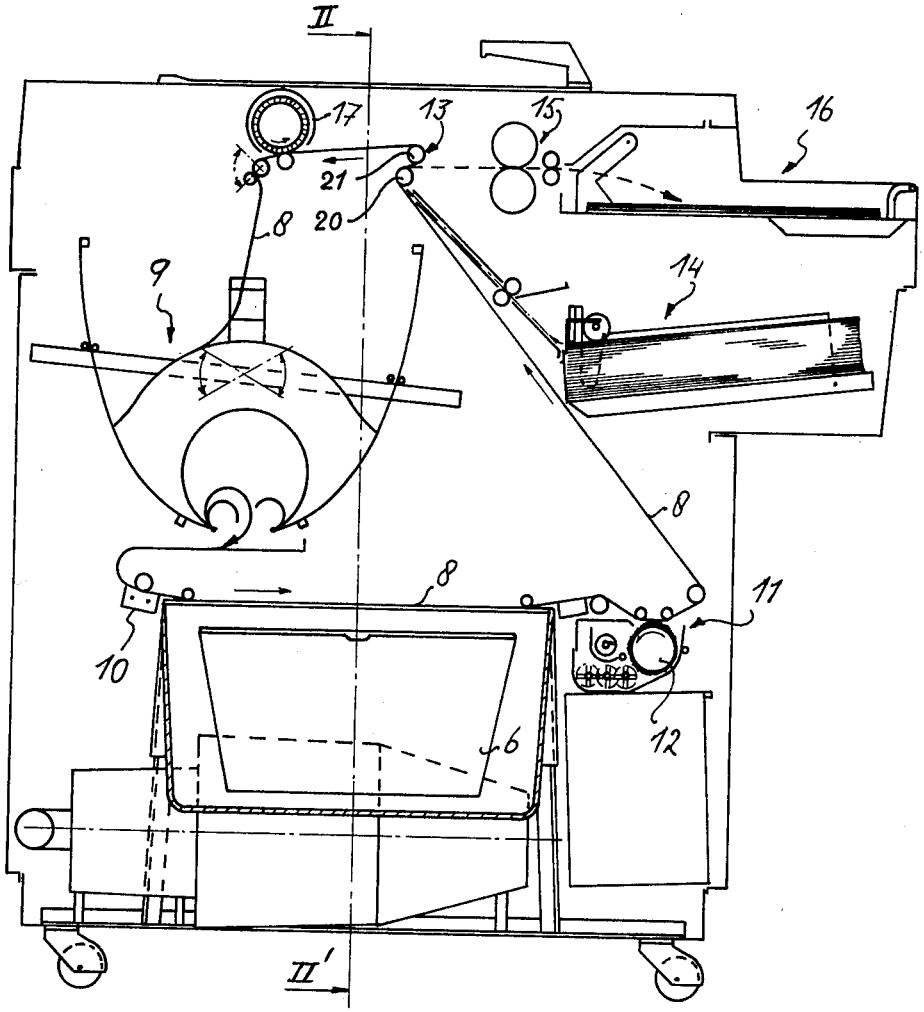
FIG. 1 is a schematic cross sectional view of an electrophotographic copying apparatus in which the invention is embodied.
Figure 2:
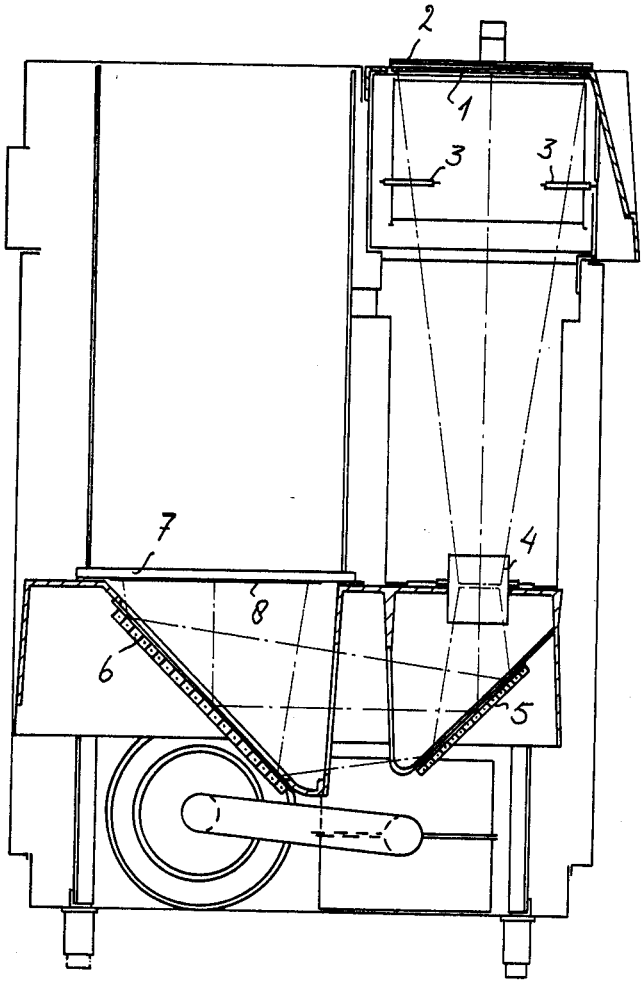
FIG. 2 is a schematic longitudinal sectional view taken along the line II—II' of FIG. 1.

The copying apparatus shown schematically in FIGS. 1 and 2 is but one of many forms of electrophotographic copying apparatus in which the present invention is useful. The invention is applicable, in general, to electrostatic copying systems in which, as is common, an image of the original to be copied is projected onto a sensitized surface of a photoconductive support, or electrophotographic plate, so as to form an electrostatic latent image thereon, after which this latent image is developed by means of an oppositely charged powder so as to form a visible powder image corresponding to the charge pattern and the powder image is subsequently transferred to a receiving material. The transferred image may then need to be fixed in order to form a permanent copy.

In the illustrated copying apparatus, which is described more particularly in U.S. Pat. No. 3,926,625, an original to be copied is placed upon a transparent exposure window 1 fixed at an exposing station (FIG. 2) and is pressed against the exposure window by means of a cover 2. The original is then exposed by means of flash lamps 3 so that an image reflected by the original is projected, via an optical system comprising a lens 4 and mirrors 5 and 6, onto a section of the photoconductive surface of an electrophotographic plate formed as an endless belt 8, which belt section is located in the projection plane 7.

As shown in FIG. 1, the endless belt 8 is transported through the apparatus by means of a number of rollers and via a magazine 9 such, for example, as that disclosed more particularly in U.S. Pat. No. 3,756,488. The portion of the length of the belt that is being used for copying is moved with a constant velocity in the direction indicated by the arrows.

The reflected image of the original is projected onto the photoconductive belt surface in the plane 7 while the belt is moving. This surface previously has been charged electrostatically by passing over a corona discharge device 10. The projected illumination image discharges the irradiated parts of the photoconductive layer, so that a latent electrostatic image corresponding to the original is formed on the belt. As the belt is transported away from the plane 7 the latent electrostatic image passes a developing station 11 where developing powder is brought into contact with the belt surface by means of a so-called magnetic brush 12; so the latent image is developed and converted into a powder image.

The powder image is then transported onward by the belt to a transfer station 13 where a sheet of copy paper moving with the same velocity as the belt is passed along with the image-carrying surface of the belt, between it and a transfer roller 20, about part of the circumference of this roller to effect transfer of the powder image onto the sheet of copy paper. A paper feed device 14 is provided for transporting the copy sheets separately and one after another into engagement between the belt 8 and the roller 20 at the transfer station.

As the belt 8 leaves the transfer roller 20 it is guided in a reverse direction about a second roller 21, so that the copy sheet with the transferred image thereon is stripped away from the belt and moved outward into a fixing device 15, in which the transferred powder image is fixed onto the sheet of copy paper. From the fixing device the sheet is transported to a receiving tray 16 where it is accessible from outside the copying machine.

The belt 8 beyond the rollers of the transfer device 13 is transported past a cleaning device 17 which removes from the photoconductive surface any remnant of the powder image that was not transferred onto the sheet of copy paper.

The copying apparatus is further provided with suitable means for driving and guiding the belt 8 in timed relation to the flash exposure of an original to be copied, for separating and feeding sheets of copy paper and transporting these sheets into the transfer station 13, and for transporting the copies produced through the fixing device 15 to the receiving tray 16.

The above description is in no respect intended to be limiting in respect of the present invention, being given only to enable a good understanding of the general operation of one form of an electrostatic copying apparatus for which the transfer system of this invention is useful.

Figure 3:
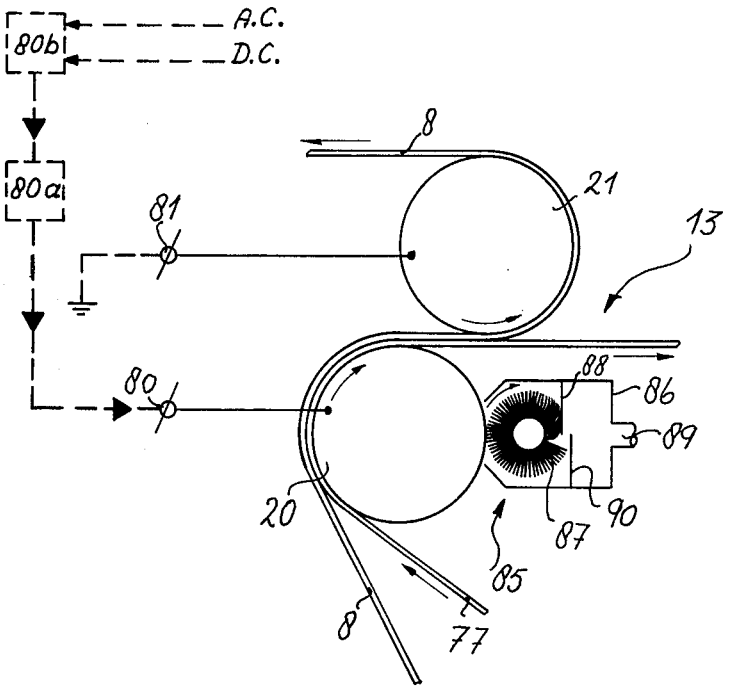
FIG. 3 is a schematic sectional view of elements of a transfer system according to the invention.

According to a preferred embodiment of this transfer system, as illustrated in FIG. 3, the belt 8 is guided over the two spaced rollers 20 and 21 at the transfer station 13 with the photoconductive layer of the belt 8 in contact with the roller 20, and a sheet of copy paper 77 being used as the image receiving material is moved about the roller 20 between its surface and the belt so that the copy sheet covers accurately the powder image previously formed on the belt 8. The rollers 20 and 21 are made of conductive material, e.g. metal, although one or both of them can also be provided with a surface sleeve having a high electrical resistance, for example, a sleeve of rubber.

For effecting transfer of the powder image from the belt 8 to the copy sheet 77, a voltage is applied between the two rollers 20 and 21 via two connectors 80 and 81, in such a way that the roller 20 attains a polarity attracting the powder image on the belt 8, while via the roller 21 the belt 8 is brought to an opposite, powder-repelling polarity. The electrical field thus generated causes the powder image to be transferred effectively from the belt 8 onto the copy paper 77.

In the practice of the invention according to the illustrated embodiment, the connector 81 is preferably connected to the earth, thus keeping the support of the image forming photoconductive layer substantially free of electrical potential, while a potential having a polarity that attracts the powder image is applied to the roller 20 via the connector 80. It results that any toner powder adhering to the belt 8 outside the area of its surface that is covered by the copy paper is likely to be transferred to the roller 20 under the influence of the applied potential. Thus, the surface of roller 20 becomes smudged.

In order to prevent smudging of the belt 8 and/or of the back side of copy paper by powder from roller 20, this roller is cleaned continuously by means of a cleaning device 85. The cleaning device 85 comprises a housing 86 having mounted therein a brush 87 which is driven by a motor (not shown) so that the brush 87 moves in the direction opposite to that of the transfer roller 20 in the region of contact of the brush with this roller. The bristles of the brush pick up powder from the surface of roller 20. The picked up powder is then removed from the brush 87 by means of a member that flicks the bristles, for instance by a partition 88 suitably located in the housing 86, and the powder particles so removed are carried away in a stream of air constantly maintained through an outlet opening 89 in the housing 86, which is connected to a vacuum suction device (not shown).

Another partition 90 is provided in the housing 86, parallel to and spaced from the flicking member 88, so as to keep the air flow directed through the zone where the brush bristles are being flicked by contact with member 88. The powder particles which the bristles fling away as they move free from compression by member 88 are caught up in the locally intensive air flow between the partitions 88 and 90 and thereupon are removed via the outlet opening 89.

The cleaning action of the brush 87 ordinarily is hampered by the fact that the transfer roller 20 is subject to a potential having a polarity that attracts the powder particles. According to the invention, this drawback is overcome by subjecting the roller 20 to such a potential that temporarily becomes zero, i.e., is interrupted, so that the cleaning device 85 can function without electrostatic opposition. To achieve this, the connectors 80 and 81 are connected to a source of a pulsating direct current potential, for instance, to a source alternating regularly from a potential of 2500 V to zero potential, instead of to a normal direct current potential source.

The source of the pulsating direct current can be a well known means for generating a block form potential, or for forming a pulsating direct current by single phase rectification of a sinusoidal alternating current potential. It is preferred, however, to use a pulsating direct current potential as obtained by single phase rectification of a current which is the result of superimposing a sinusoidal alternating current potential and a direct current potential. FIG. 3 illustrates schematically for this purpose a single phase rectifier **80*a* which is connected with connector 80 and acts on the current output from a unit 80*b*** that combines the current from a sinusoidal A.C. source with the current from a D.C. source. Any of the several forms of pulsating direct current potentials can be obtained by convential means which are well known to an expert.

In order to obtain a good cleaning operation, it is important that the time of contact of any part of the photoconductive layer 8 with the receiving material 77, as well as the time of contact of the cleaning brush 87 with any area of the roller 20, be greater than the period, or interval between interruptions, of the pulsating direct current potential. In this way it is assured that, within the shortest contact time, the current will be interrupted at least once. This means, for example, that when the velocity of the photoconductive belt is 15 meters per minute, the diameter of the roller 20 is 50 mm, the length of the region of contact of the belt 8 with the copy sheet 77 at the roller 20 is 25 mm, and the length of the region of contact of the brush 86 with the roller 20 is 10 mm, the frequency of the pulsating direct current potential must be at least 25 Herz. In other words, for the stated conditions of the example, at least 25 interruptions of the direct current potential are needed per second in order to assure both (1) that all areas of the photoconductive layer 8 will have been subjected to the transfer potential and (2) that all areas of the surface of roller 20 will have been subjected to the cleaning action of the brush at a moment when the potential is interrupted.

The dimension of the transfer roller 20, the velocity of the belt 8 and the two contact lengths are the parameters for determining the minimum frequency of the pulsating direct current potential. In general, the frequency of the pulses can be selected at any desired value between 20 and 1000 Herz, but it usually will lie in the range between 40 and 100 Herz. In practice, it is usually advantageous to employ a frequency corresponding to that of the main voltage, i.e. 50 or 60 Herz, because this enables the avoidance of complicated and therefore expensive provisions in the electrical circuit for changing the current frequency. When the several parameters have the values stated for the example mentioned above, the customary mains frequency of 50 or 60 Herz will provide potential interruptions at a frequency within the required range, being considerably greater than 25 Herz; so the simplest electrical circuit can be used.

The contact time of the belt 8 with the receiving material 77 differs in effects from the contact time of the roller 20 with the brush 87, as it not only is a factor in determining the period time of the pulsating direct current potential but also influences the quality of the transfer of the powder image onto the receiving material 77. If the potential used for transferring the powder image does not exceed a certain value during a long enough time, the image quality of the copy obtained is disturbed due to the powder image not being completely transferred. The contact time of the belt 8 with the receiving material is, therefore, kept longer than the contact time of the roller 20 with the brush 87, so that a plurality of pulses of the direct current potential are generated within the time of contact of any portion of the belt surface with the receiving material.

Figure 4:
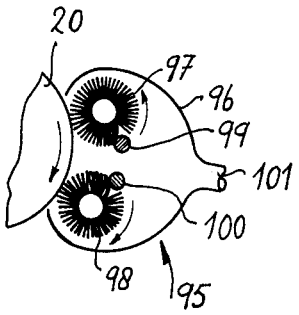
FIG. 4 is a schematic sectional view of a modification of the roller cleaning device of the transfer system.

FIG. 4 shows schematically a modified embodiment of a cleaning device for the transfer roller, in which two cylindrical brushes 97 and 98 are rotatably mounted within a housing 96. The brushes 97 and 98 each have a certain zone of contact with the roller 20, and they rotate in opposite directions as indicated by the arrows. The brushes 97 and 98 cooperate with flicking members 99 and 100, respectively, so that toner particles picked up by the brushes are released from the brush bristles and can be sucked away through an outlet 101 in the housing 96 by means of a vacuum suction device (not shown).

The embodiment making use of two brushes can be advantageous in comparison with the embodiment according to FIG. 3, having a single brush, in that, in order to obtain the same contact length between the cleaning device and the roller 20, only half of the required contact length needs be provided by each of two brushes; alternatively, if each of two brushes provides the contact length required for a single brush, a lower frequency can be used for the D.C. pulses.

I claim:

1. In apparatus for electrostatically transferring powder images, comprising an image-carrying support, a rotatable transfer roller, means for transporting said support over said roller with the image supporting side of said support in face to face contact with a part of the circumference of said roller, means for transporting image receiving material between said support and said roller, means for generating an electrical field between said support and the receiving material, and means including at least one cylindrical brush rotatable in contact with said roller for cleaning powder from its surface, the improvement wherein said field generating means comprises means for generating between said support and said transfer roller a pulsating direct current the period time of which is less than the time of contact of any area of said support with the receiving material and less than the time of contact of said at least one cleaning brush with any area of said transfer roller, said support, said transfer roller, said at least one brush and said transporting means being arranged so that said time of contact of any area of said support with the receiving material is longer than said time of contact of said at least one brush with any area of said transfer roller.

2. Apparatus according to claim 1, said generating means including means for generating a said pulsating direct current having a frequency between 20 and 1000 Herz.

3. Apparatus according to claim 1, said generating means including means for generating a said pulsating direct current having a frequency between 40 and 100 Herz.

4. Apparatus according to claim 1, said generating means including means for generating a said pulsating direct current having a frequency of 60 Herz or 50 Herz corresponding to that of a main A.C. current supply.

5. Apparatus according to claim 1, said generating means including means for generating as said pulsating direct current a block form pulsating current.

6. Apparatus according to claim 1, said generating means including means for generating a said pulsating direct current by single phase rectification of a sinusoidal alternating current.

7. Apparatus according to claim 1, said generating means including means for generating a said pulsating direct current by single phase rectification of a current formed by superimposing a sinusoidal alternating current and a direct current.

8. Apparatus according to claim 1, said generating means including means for generating a said pulsating direct current having a frequency of 60 Herz or 50 Herz by single phase rectification of a current formed by superimposing a sinusoidal alternating current having said frequency and a direct current.

9. In apparatus for electrostatically transferring powder images, comprising an image-carrying support, a rotatable transfer roller, means for transporting said support over said roller with the image supporting side of said support in face to face contact with a part of the circumference of said roller, means for transporting image receiving material between said support and said roller, means for generating an electrical field between said support and the receiving material, and means including at least one cylindrical brush rotatable in contact with said roller for cleaning powder from its surface, the improvement wherein said field generating means comprises means for generating between said support and said transfer roller a pulsating direct current the period time of which is less than the time of contact of any area of said support with the receiving material and less than the time of contact of said at least one cleaning brush with any area of said transfer roller, said generating means including means for generating a said pulsating direct current by single phase rectification of a current formed by superimposing a sinusoidal alternating current and a direct current.

10. Apparatus according to claim 9, said generating means including means for generating a said pulsating direct current having a frequency of 60 Herz or 50 Herz by single phase rectification of a current formed by superimposing a sinusoidal alternating current having said frequency and a direct current, said support, said transfer roller, said at least one brush and said transporting means being arranged so that the time of contact of any area of said support with said receiving material is considerably longer than the time of contact of said at least one brush with any area of said transfer roller.

11. In a method of transferring a powder image from an image-carrying support to a receiving material, wherein said support is transported over a rotatable transfer roller with its image supporting side in face to face contact with a part of the circumference of said roller, the receiving material is transported between said support and said roller, an electrical field is generated between said support and the receiving material to effect transfer of the powder image to the latter, and at least one cylindrical brush is rotated in contact with another part of said circumference for cleaning powder from the surface of said roller, the improvement which comprises providing said electrical field by maintaining between said support and said transfer roller, while keeping the back of said support grounded, a pulsating direct current having a frequency of 60 Herz or 50 Herz, said current being generated by single phase rectification of a current formed by superimposing a sinusoidal alternating current having said frequency and a direct current, keeping each area of said support in contact with the receiving material, and said at least one cleaning brush in contact with each area of said transfer roller, for a time longer than the time period between interruptions of said pulsating current, and keeping the contact time of said support with said roller considerably longer than the contact time of said at least one brush with said roller.

* * * * *